US006695924B1

(12) United States Patent
Dube et al.

(10) Patent No.: US 6,695,924 B1
(45) Date of Patent: Feb. 24, 2004

(54) METHOD OF IMPROVING FLAVOR IN SMOKING ARTICLE

(76) Inventors: Michael Francis Dube, 130 Northpond La., Winston-Salem, NC (US) 27106; Luis Mayan Dominguez, 230 Lucerne La., Winston-Salem, NC (US) 27104; Chi-Kuen Shu, 4409 Lochurst Dr., Pfafftown, NC (US) 27040; Elwood Lee Williams, Jr., 206 Flintridge Dr., Lewisville, NC (US) 27023; Kenneth Wayne Smith, 253 Creekbend Dr., Winston-Salem, NC (US) 27103; William Monroe Coleman, III, 2900 Loch Dr., Winston-Salem, NC (US) 27106

( * ) Notice: Subject to any disclaimer, the term of this patent is extended or adjusted under 35 U.S.C. 154(b) by 0 days.

(21) Appl. No.: 09/624,820

(22) Filed: Jul. 25, 2000

(51) Int. Cl.[7] ..... A24B 15/00; A24D 1/00

(52) U.S. Cl. ..... 131/274; 131/276; 131/275; 131/309; 131/310; 131/364; 127/DIG. 1; 426/658; 426/661

(58) Field of Search ..... 131/274, 359, 131/352, 369, 309, 310, 276, 275, 364; 127/34, DIG. 1; 426/658, 661

(56) References Cited

U.S. PATENT DOCUMENTS

| | | | | | |
|---|---|---|---|---|---|
| 2,930,720 | A | * | 3/1960 | Finberg | 131/359 |
| 3,112,754 | A | * | 12/1963 | Diaz | 131/2 |
| 3,316,919 | A | | 5/1967 | Green et al. | |
| 3,424,171 | A | | 1/1969 | Rooker | |
| 3,478,015 | A | | 11/1969 | Onishi et al. | |
| 3,618,588 | A | * | 11/1971 | Anwar | 127/34 |
| 3,622,343 | A | * | 11/1971 | Anwar et al. | 99/78 |
| 3,722,516 | A | | 3/1973 | Suwa et al. | |
| 3,760,815 | A | | 9/1973 | Deszyck | |
| 3,828,798 | A | | 8/1974 | Harper et al. | |
| 3,920,026 | A | | 11/1975 | Warfield et al. | |
| 3,929,141 | A | | 12/1975 | Beringer et al. | |
| 3,934,594 | A | | 1/1976 | Beringer et al. | |
| 3,942,537 | A | * | 3/1976 | Evers et al. | 131/278 |
| 4,040,431 | A | | 8/1977 | Ashworth et al. | |
| 4,079,742 | A | | 3/1978 | Rainer et al. | |
| 4,109,664 | A | * | 8/1978 | Hedge | 131/359 |
| 4,150,677 | A | | 4/1979 | Osborne, Jr. et al. | |
| 4,184,495 | A | | 1/1980 | Rainer et al. | |
| 4,286,606 | A | | 9/1981 | Swain et al. | |
| 4,306,577 | A | | 12/1981 | Wu et al. | |
| 4,407,307 | A | | 10/1983 | Gaisch et al. | |
| 4,421,126 | A | | 12/1983 | Gellatly | |
| 4,481,956 | A | | 11/1984 | Chan | |
| 4,506,682 | A | | 3/1985 | Muller | |
| 4,516,590 | A | | 5/1985 | Teng | |
| 4,537,204 | A | | 8/1985 | Gaisch et al. | |
| 4,538,627 | A | | 9/1985 | Chan et al. | |
| 4,566,468 | A | | 1/1986 | Sachleben et al. | |
| RE32,095 | E | | 3/1986 | Wu et al. | |
| 4,596,259 | A | | 6/1986 | White et al. | |
| 4,605,016 | A | | 8/1986 | Soga et al. | |
| 4,607,646 | A | | 8/1986 | Lilly, Jr. et al. | |
| 4,628,947 | A | | 12/1986 | Driscoll et al. | |
| 4,638,816 | A | | 1/1987 | Cox et al. | |
| 4,674,519 | A | | 6/1987 | Keritsis et al. | |
| 4,677,994 | A | | 7/1987 | Denier et al. | |
| 4,701,282 | A | | 10/1987 | Chan et al. | |
| 4,715,388 | A | | 12/1987 | Rainer | |
| 4,744,375 | A | | 5/1988 | Denier et al. | |
| 4,760,854 | A | | 8/1988 | Jewell et al. | |
| 4,827,949 | A | | 5/1989 | Sunas | |
| 4,941,484 | A | | 7/1990 | Clapp et al. | |
| 4,986,286 | A | | 1/1991 | Roberts et al. | |
| 5,016,654 | A | | 5/1991 | Bernasek et al. | |
| 5,018,540 | A | | 5/1991 | Grubbs et al. | |
| 5,038,802 | A | | 8/1991 | White et al. | |
| 5,060,663 | A | | 10/1991 | Rainer | |
| 5,060,669 | A | | 10/1991 | White et al. | |
| 5,065,775 | A | | 11/1991 | Fagg | |
| 5,074,319 | A | | 12/1991 | White et al. | |
| 5,099,862 | A | | 3/1992 | White et al. | |
| 5,121,757 | A | | 6/1992 | White et al. | |
| 5,131,415 | A | | 7/1992 | Munoz et al. | |
| 5,159,942 | A | | 11/1992 | Brinkley et al. | |
| 5,234,008 | A | | 8/1993 | Fagg | |
| 5,235,992 | A | | 8/1993 | Sensabaugh, Jr. | |
| 5,284,166 | A | | 2/1994 | Cartwright et al. | |
| 5,318,050 | A | | 6/1994 | Gonzalez-Parra et al. | |
| 5,339,838 | A | | 8/1994 | Young et al. | |
| 5,413,122 | A | | 5/1995 | Shu et al. | |
| 5,454,874 | A | * | 10/1995 | Richards | 127/34 |
| 5,598,868 | A | | 2/1997 | Jakob et al. | |
| 6,048,404 | A | | 4/2000 | White | |
| 6,180,158 | B1 | * | 1/2001 | Zietlow et al. | 426/571 |

FOREIGN PATENT DOCUMENTS

| | | |
|---|---|---|
| DE | 1 517 280 | 9/1969 |
| EP | 0 110 693 A1 | 6/1984 |
| EP | 0 517 407 A2 | 12/1992 |
| EP | 0 821 886 A2 | 2/1998 |
| FR | 2 767 649 A1 | 3/1999 |
| GB | 572236 | 9/1945 |
| GB | 1383029 | 2/1975 |
| GB | 2 239 654 A | 7/1991 |
| JP | 57-71388 | 5/1982 |
| JP | 61-15675 A2 | 1/1986 |
| WO | WO 97/04673 A1 | 2/1997 |

OTHER PUBLICATIONS

*Factors Affecting the Formation of Pyrazine Compounds in Sugar–Amine Reactions*, P. E. Koehler et al., J. Agr. Food Chem., vol. 18, No. 5, 1970, pp. 895–898.

(List continued on next page.)

*Primary Examiner*—Dionne A. Walls
(74) *Attorney, Agent, or Firm*—Alston & Bird LLP

(57) ABSTRACT

A method for improving the flavor and aroma characters of a smoking article is provided. A mixture consisting essentially of a reducing sugar and optionally a hydroxide of an alkali metal is subjected to heat treatment for a time and under conditions sufficient to produce a flavorful composition. The flavorful composition is then applied to tobacco leaves or cut filler made thereof, and smoking articles are prepared from the tobacco leaves or cut filler.

26 Claims, No Drawings

OTHER PUBLICATIONS

*Formation of Pyrazine Compounds in Sugar–Amino Acid Model Systems*, P. E. Koehler et al., J. Agr. Food Chem. , vol. 17, No. 2, Mar.–Apr. 1969, pp. 393–396.

*Mutarotation, Hydrolysis, and Rearrangement Reactions of Glycosylamines*, H. S. Isbell et al., The Journal of Organic Chemistry, vol. 23, No. 8, 1958, pp. 1309–1319.

*Parameter Effects on the Thermal Reaction of Cystine and 2,5–Dimethyl–4–hydroxy–3(2H)–Furanone*, C. Shu et al., Chap. 21, Thermal Generation of Aromas, 1989 American Chemical Society, pp. 229–241.

*Pyrazine Formation From Serine and Threonine*, C. Shu, J. Agric. Food Chem., vol. 4A, No. 10, 1999, pp. 4332–4335.

*Studies on the Aroma of Roasted Coffee*, W. Grosch et al., Thermally Generated Flavour, Flavour Science: Recent Developments, pp. 200–205.

The Design of Cigarettes, C. L. Browne, 1979, pp. 17–24, 56.

*The Reaction of Glucose with Some Amines*, E. Mitts et al., Journal of the American Chemical Society, vol. 66, No. 2, 1944, pp. 483–487.

*The Variety of Odors Produced in Maillard Model Systems and How They Are Influenced by Reaction Conditions*, M. J. Lane et al., Maillard Reactions, 1983 American Chemical Society, pp. 141–158.

*Carmel*, Properties and Analysis, Encyclopaedia of Food Science Food Technology and Nuritrion, pp. 655–664.

*Analysis of Aromatic Caramel*, I. Pons et al., Food Chemistry 39 (1991) pp. 311–320.

*Formation of Furaneol in Heat–Processed Foods*, P. Schieberle, Flavor Precursors Thermal and Enzymatic Conversions, 1992 American Chemical Society, Chapter 12, pp. 164–174.

*GC and Sensory Techniques Coupled in Caramel Flavor Analysis*, I. Pons, Perfumer & Flavorist, vol. 20, Mar./Apr. 1995, pp. 15–18.

* cited by examiner

METHOD OF IMPROVING FLAVOR IN SMOKING ARTICLE

FIELD OF THE INVENTION

The present invention generally relates to smoking articles such as cigarettes, and in particular to smoking articles with improved flavor and aroma and process for making same.

BACKGROUND OF THE INVENTION

Popular smoking articles, such as cigarettes, have a substantially rod shaped structure and include a charge of smokable material such as strands or shreds of tobacco (e.g., tobacco cut filler) surrounded by a paper wrapper thereby providing a so-called "tobacco rod."

During smoking, the tobacco cut filler in the tobacco rod is heated and burned producing smoke. The flavor and aroma of the smoke are important characteristics of smoking articles. In conventional cigarette manufacturing processes, a large amount of sugar is typically applied as a casing ingredient to tobacco leaf blends, especially air-cured blends, before cutting. Conventionally, this casing process involves applying sugar as a solution and then heating the sugar-treated tobacco at a relatively high temperature. Normally a portion of the sugar is caramelized, i.e., undergoes Browning reactions, during the heating step, thus generating caramel-like compounds. Some of these caramel compounds exhibit flavors which are believed to be important in masking the bitterness in the smoke and improving the flavor of the smoking article.

The term "caramel" is generally used to designate a group of a large number of complex molecules with different chemical properties. Several types of caramel are known in the art including plain caramel, caramel produced by ammonia process or caustic process, and caramel produced by an ammonium sulphite process. The color and flavor can vary somewhat with the different types of caramel. Caramel normally exhibits a brown color and the darkness of the brown color of a particular caramel preparation can vary depending on the caramel preparation process. Normally, caramel produced by either the ammonia process, the caustic process, or the ammonium sulphite process, exhibits darker colors and is especially suited as coloring agent.

Various caramel compositions have been used or proposed for use as components of cigarettes. For example, caramel has been used as a coloring agent for cigarette wrappers. See U.S. Pat. No. 5,284,166. Caramel has also been used in the substitute fillers of substitute cigarettes as a coloring agent and to simulate natural tobacco material. See U.S. Pat. Nos. 3,934,594 and 3,929,141, and France Patent No. 2,767,649.

Although it is conventionally understood that sugar is incorporated into tobacco as a casing component, it is caramelized during the manufacturing process and during smoking. In many cases, the complex chemistry of tobacco can interfere with the caramelization process. In particular, the sugar can react with other components of the tobacco materials in the smoking article including carboxylic acids and nitrogen sources. As a result, the yield of the desirable sweet and caramel-like flavor materials generated in situ by sugar caramelization is usually low. Moreover, since the conventional casing heating step does not caramelize or otherwise convert all of the applied sugar into flavorant compounds, the remaining sugar is heated during smoking in the smoking article, but the heating process applied to tobacco during smoking is not optimum for increasing the yield of desirable caramel-like flavorants.

SUMMARY OF THE INVENTION

The present invention provides for a method of improving the flavor and aroma characters of a smoking article by heating a sugar optionally in admixture with a hydroxide to generate a flavorful caramel which is essentially free of any nitrogen-containing caramel compounds, and the caramel composition is applied to tobacco materials that are used to provide a smoking article.

In particular, in accordance with the present invention, a mixture is provided containing a reducing sugar and optionally a hydroxide. Typically, the mixture is in an aqueous form. A hydroxide of an alkali metal including sodium hydroxide, potassium hydroxide, and the like is preferably included in the mixture. Normally, the mixture does not contain any significant amount of amino or other components that are capable of reacting with the reducing sugar so as to substantially interfere or compete with the caramelization of the reducing sugar or to generate a substantial amount of non-caramel flavor substances.

The mixture is exposed to a temperature sufficiently high and for a period of time sufficiently to provide a flavorful caramel composition. Normally, heat treatment is conducted at a temperature of at least about 90° C., preferably at least about 100° C., more preferably at least about 120° C. The resultant flavorful aqueous composition contains a substantial amount of flavorful caramel compounds including furaneol, maltol, cyclotene, α-Angelica lactone, and the like. In addition, the flavorful caramel composition also contains unreacted reducing sugar.

The flavorful caramel composition can be employed in improving the flavor characteristics of smoking articles such as cigarettes. In particular, the flavorful composition is applied directly to tobacco materials as a casing component or top dressing ingredient. The flavorful composition is especially suited for application to tobacco leaves or tobacco cut fillers. Smoking articles made from the tobacco leaves or tobacco cut fillers exhibit significantly improved flavor that are pleasant, sweet, and caramel-like.

In the method of the present invention, the caramelization of sugars is conducted externally from the tobacco, and in a controlled environment that can be optimized for the caramelization reaction, preferably in an enclosed environment under pressure, and in the absence of interference from other chemical compounds such as nitrogen sources. As a result, a greater amount of caramel-like flavorants can be generated from a relatively small amount of sugar. In addition, the flavorful caramel composition employed in this invention is essentially free of nitrogen-containing substances and therefore exhibits desirably pure pleasant, sweet, and caramel-like flavor. In addition, the caramel composition contains a lower content of undesirable caramel species and solid carbon precipitates and black pigments, and thus exhibits improved color properties. The flavorful caramel composition can be applied to tobacco materials as a casing or top dressing ingredient, so that other materials typically used in conventional casing can be reduced or even omitted from the smoking article of the present invention. The resultant smoking article exhibits unique pleasant flavor.

The foregoing and other advantages and features of the invention, and the manner in which the same are accomplished, will become more readily apparent upon consideration of the following detailed description of the preferred embodiments of the invention.

DETAILED DESCRIPTION OF THE INVENTION

This invention provides for a method of improving the flavor characters of a smoking article by heating an essentially nitrogen-free mixture containing a reducing sugar and optionally a hydroxide-containing base compound to generate a flavorful composition and applying the composition to tobacco materials in the smoking article.

Suitable reducing sugars that can be used in the invention include, but are not limited to, glucose, fructose, sucrose, mannose, galactose, rhamnose, and mixtures thereof. The reducing sugar can be in a pure form or in unrefined form, e.g., high fructose corn syrup (HFCS) which has a high content of fructose. Other derivatives of reducing sugars can also be used, e.g., phosphate-substituted reducing sugars (e.g., glucose-6-phosphate, fructose-6-phosphate, and fructose-1,6-diphosphate). Reducing sugars can also be provided in the form of precursors that can readily release reducing sugars under the reaction conditions employed in the method of this invention. Examples of suitable precursors can include disaccharides and polysacchrides, and derivatives thereof. In such cases, reducing sugars can be generated by the hydrolysis of disaccharides or polysaccharides. In a preferred embodiment of the invention, a high fructose corn syrup (HFCS) having at least about 30% by weight of fructose is used as the reducing sugar component. For example, a high fructose corn syrup having about 42% by weight of fructose is commercially available from Corn Products International, Bedford Park, Ill.

Optionally, the mixture also contains a strong non-amino-base compound, preferably an alkali metal hydroxide such as sodium hydroxide, potassium hydroxide, and the like. It has been discovered that alkali hydroxide can increase the yield of flavorful caramel components without causing the formation of a substantial amount of undesirable insoluble solid materials in the resultant flavorful aqueous composition as can be generated by, e.g., ammonium hydroxide or ammonium carbonate. Preferably, sodium hydroxide is used.

The mixture typically does not contain any significant amount of chemicals that will substantially interfere with the caramelization reactions of the reducing sugars. Preferably, the mixture does not contain any significant amount of amino compounds or other components that are capable of reacting with the reducing sugars to generate nitrogen-containing caramels or compounds other than caramel components. For example, it has been observed that when ammonium compounds such as diammonium phosphate is included in the mixture, not only non-caramel flavor substances are generated after heat treatment, but also the resultant composition contains an undesirable amount of solid carbon precipitates or black pigments.

Three general kinds of caramel are known in the art: (1) plain caramel, (2) caramel produced by ammonia process or caustic process, (3) caramel produced by an ammonium sulphite process. The heat treatment of the mixture of this invention is intended to produce plain caramel but not the other two types of caramels. Accordingly, the mixture of the present invention preferably does not include ingredients such as ammonium compounds (e.g., ammonia, ammonium hydroxide, and ammonium salts such as diammonium phosphate), amino acids, and the like. Moreover, even though the caramelization process employed in the invention can involve use of an alkali metal hydroxide, the resultant caramel is substantially different from caustic process caramels because the level of the hydroxide in the mixture of the present invention is substantially lower than that used for making caustic caramels. The content of alkali metal hydroxide (calculated on a water-free basis) can be from about 0% to about 30%, preferably from about 0.5% to about 10% by weight based on the total weight of the mixture.

Generally, the total content of any undesirable reactive materials should be less than about 1% by weight based on the reducing sugar content, preferably less than 0.3% by weight, more preferably less than 0.10% by weight. Other known flavorants such as cocoa and licorice can be included in the mixture. However, in a preferred embodiment, the mixture contains only reducing sugar(s) and optionally sodium hydroxide.

In the reaction mixture, the content of reducing sugar can be from about 5% to about 80%, preferably from about 20% to about 60%, and more preferably from about 30% to about 50% by weight (dry weight basis) based on the total weight of the mixture.

The reaction mixture can be in a solid or liquid form. Typically the reaction mixture is in an aqueous form. The reducing sugar and optionally alkali metal hydroxide are mixed together with a liquid medium having an aqueous character such as a liquid consisting primarily of water, normally greater than about 90 weight percent water, and can be essentially pure water. For example, the liquid medium can be distilled water, tap water, or the like.

The caramelization reaction is conducted by subjecting the aqueous mixture to heat treatment for a time and under conditions sufficient to generate a flavorful caramel composition. The aqueous mixture can be heated to a temperature of at least about 90° C., preferably at least about 100° C., more preferably to a temperature of at least about 125° C. Advantageously, the heat treatment is conducted at a temperature of at least about 150° C. or greater. However, it is desirable to subject the mixture to a temperature below temperatures causing an undesirable formation of components that are deleterious to the flavor characteristics of the flavorful caramel composition produced. Normally, the heat treatment is conducted at a temperature preferably below about 200° C.

The heat treatment of the mixture can be conducted under an ambient pressure environment, i.e., in a vented reactor. However, it is preferred that the mixture is heated in an enclosed pressure-controlled environment. Such an environment is provided by enclosing the mixture in an air sealed vessel or chamber. Typically, a pressure-controlled environment is provided using a pressure vessel or chamber which is capable of withstanding relatively high pressures. Preferred pressure vessels are equipped with an external heating source. Examples of vessels which provide a pressure controlled environment include reactors sold by American Reactor Corporation having a sealable vent and a heating jacket, a high pressure autoclave from Berghof America Inc., and a Parr Reactor Model No. 4522 from The Parr Instrunent Co. Operation of such exemplary vessels will be apparent to the skilled artisan. Typical pressures experienced by the mixture during the process of the present invention range from about 10 psig to about 1,000 psig, normally from about 20 psig to about 500 psig. Pressures experienced by the mixture typically exceed 100 psig during the process of the present invention. The heat treatment of the mixture under pressure can be performed under an inert atmosphere. For example, nitrogen or argon gas can be employed in order to provide an inert atmosphere. However, the heat treatment can also be conducted under ambient air.

The amount of time required for the heat treatment can vary with the temperature. Typically, less time is necessary if the aqueous mixture is under a moderate heat treatment. Conversely, more time is required when the reacting temperature is low. Preferably the time and temperature are sufficient to cause reaction of at least about 5%, preferably at least about 10%, more preferably at least about 25% by weight of the starting sugars or precursors to be caramelized. Advantageously, at least about 50% of the sugars is caramelized. For example, satisfactory results are typically achieved when an aqueous mixture is heated at about 100° C. for about 3 hours, or at about 175° C. for about 10 minutes. Normally, it is desirable to control the time/temperature profile of the heat treatment so that the mixture is not subjected to a particularly high temperature for a lengthy period of time and the generation of materials deleterious to the flavor characteristics of the resultant flavorful composition is avoided. Some minor experiments may be required to determine the optional reacting time at a particular temperature, this being well within the capability of one skilled in the art once apprised of the present disclosure.

In addition, it is highly desirable to employ a pressure vessel equipped with an agitation mechanism such that the mixture experiences a relatively uniform temperature throughout the treatment period. In particular, it is highly desirable for the mixture to be heated uniformly throughout as much as possible at the maximum temperature to which the mixture is subjected.

The heat treatment of the mixture in the present invention typically leads to the caramelization of the reducing sugar, and the resultant flavorful composition contains a substantial amount of caramel components including, but not limited to, firaneol, maltol, cyclotene, α-Angelica lactone, and the like. The composition also contains a large amount of unreacted reducing sugar, typically at an amount of at least about 25% by weight based on the total weight of the composition. Typically the heat treatment results in a flavorful composition that is aqueous which does not contain a substantially amount of solid aggregates. The aqueous composition may optionally be filtered, e.g., through a 60-mesh screen filter to remove large solid aggregates.

The flavorful composition thus prepared can be incorporated into smoking articles thus producing smoking articles containing "externally produced" caramel components. The term "extremely produced" is used herein to refer to the caramel components produced externally independent of tobacco materials, i.e., caramel components that are neither produced on or in the tobacco during processing thereof nor generated in situ during smoking of the smoking article.

The flavorful composition produced in the method of this invention can be incorporated into smoking articles by various methods. The composition can be concentrated to reduce the water content and increase the content of useful flavorful compounds. Alternatively, the flavorful composition produced after heat treatment is used without additional processing.

In accordance with the present invention, the flavorful composition generated in the present invention is applied directly onto tobacco leaves or tobacco cut fillers made therefore as a casing material or top dressing ingredient. As is well known in the art, casing materials are used as additives to enhance the flavors in smokable materials. In cigarette manufacturing processes, casing materials are typically added to tobacco leaf blends before cutting. Casing materials are usually applied as suspensions or solutions. Exemplary casing ingredients that are commonly used in the art include, e.g., sugar, humectants such as glycerine or a higher glycol, licorice, cocoa, etc. The flavorful composition prepared in the present invention can be mixed with any of the conventional ingredients suspended or dissolved in the casing. The flavorful composition can also be used as the only casing ingredient. The casing can be applied to the leaf blend by either spraying or as a dip casing, or by other processes known in the art to allow the flavorful compounds in the composition to be coated onto or absorbed by the tobacco leaf blend.

The flavorful composition produced in the present invention is rich in flavorful caramel components as well as sugars. Accordingly, in advantageous embodiments of the invention, sugars and other ingredients added via conventional casing or like treatments can be reduced or eliminated. Advantageously, no additional casing ingredients are used other than the flavorful composition of the present invention.

The flavorful composition produced in accordance with the method of the present invention can also be incorporated into smoking articles as a top dressing ingredient. As is well known in the art, top dressing is added after the tobacco blend is cut into shreds or "cut fillers," to supply aroma or pleasing flavor. Top dressing is usually applied as a spray solution containing highly aromatic, perfume-like substances and a material such as a glycol to retard the evaporation of the flavorant in the cigarette or cigarette package. The flavorful composition can thus be used as a top dressing ingredient in the top dressing spray solution. The aqueous flavorful composition alone or in admixture with other conventional top dressing ingredients (e.g., humectants such as glycerol and the like, aroma-enhancing flavorants, etc.) can be sprayed onto the tobacco shreds or cut fillers. The composition can also be incorporated into smoking articles concurrently as the tobacco cut filler is formed into cigarette rods.

The tobacco leaf blends or cut fillers having the flavorful composition of this invention applied therein can also be used in a similar manner in many types of smoking articles other than the currently widely available cigarette constructions. For example, tobacco cut filler having the flavorful composition applied therein may be combined with aerosol forming materials, and employed in the manufacture of those smoking articles described in U.S. Pat. Nos. 4,708,151 to Shelar; 4,771,795 to White et al.; 4,714,082 to Banerjee et al.; 4,756,318 to Clearman et al.; and 4,793,365 to Sensabaugh et al., as well as European Patent Publication Nos. 212,234 and 277,519, the disclosures of which are incorporated herein by reference. In addition, the tobacco cut filler can also be incorporated into those smoking articles described in U.S. Pat. No. 5,074,321 and European Patent Publication No. 280,990.

The amount of the flavorful composition employed in smoking articles can vary. Generally up to 10-20% of the resulting liquid flavorful composition based on the dry weight of tobacco materials, can be applied to tobacco, including blends and tobacco components that are used to prepare cigarettes. Typically, the flavorful composition is applied at an amount of from about 5% to about 8% by weight based on the total dry weight of the tobacco leaf or cut filler in the smoking article. When a large amount of the flavorful composition needs be added, the tobacco leaves or cut filler can be dried to some extent to reduce the moisture content thereof before or after the liquid composition is applied thereto. In this way, heating the impregnated tobacco leaves or cut filler to reduce moisture before packaging into cigarette rods can be minimized. Preferably, smoking articles, e.g. cigarettes prepared by the method of this invention contain at least the following caramel components: at least about 5 ppm of cyclotene, preferably at least about 10 ppm of cyclotene, at least about 7.5 ppm of furaneol and maltol, preferably at least about 25 ppm of furaneol and maltol wherein the caramel components are provided from the flavorful caramel composition prepared in this invention. When smoked, smoking articles prepared in accordance with the present invention exhibit pleasant, sweet, bum, and caramel-like flavors.

The following example is provided in order to further illustrate preferred aspects of the invention but should not be construed as limiting the scope thereof. Unless otherwise noted, all parts and percentages are by weight.

EXAMPLE 1

100 grams of high fructose corn syrup (HFCS) (Corn Products International, Bedford Park, IL) containing 42% by weight of fructose was mixed thoroughly with 5 ml of NaOH solution (33% by weight) in a round bottom flask. The mixture was heated to and held at 100° C. for three hours. The reaction mixture obtained was immediately cooled to room temperature using cold water. The resultant composition was tested for the contents of caramel components by the method described below. The result is shown in Table 1.

The furaneol, maltol, cyclotene, and α-angelica lactone contents were determined by a reversed-phase HPLC method with UV detection at 280 run. The system used for these measurements was a Waters 2690XE Alliance HPLC system with a Waters 486 Tunable Absorbance Detector set at 280 nm. The autosampler was kept at 4° C. at all times. The column employed for this separation was a Beckman ODS™, 5μm, $C_{18}$ reversed-phase column (4.6 ×250 mm). The mobile phase consisted of a gradient consisting of 90% deionized water with 0.005M $KH_2PO_4$ and 0.09M Acetic Acid, 10% methanol to 80% deionized water with 0.005M $KH_2PO_4$ and 0.09M Acetic Acid, 20% methanol in 10 minutes using a linear gradient. The gradient rate was thus 1%/min.

Samples were prepared by accurately weighing about 0.55 grams of a caramel cooked casing and dissolving in 5.0 ml of deionized water. This mixture was filtered through a Whatman PVDF Autovial-5™ directly into a Waters autosampler vial. Injection volume was 50 μl. The method could not resolve furaneol and maltol but measured their sum. A standard addition experiment demonstrated that the method was accurate as well as repeatable.

EXAMPLE 2

200 grams of high fructose corn syrup (HFCS) (Corn Products International, Bedford Park, IL) containing 42% by weight of fructose was mixed thoroughly with 10 ml of NaOH solution (33% by weight) in round bottom flask. The mixture was heated to and held at 175° C. for 10 minutes. The reaction mixture obtained was immediately cooled to room temperature using cold water. The resultant composition was tested for the contents of caramel components by the method described in Example 1. The result is shown in Table 1.

EXAMPLE 3

200 grams of high fructose corn syrup (HFCS) (Corn Products International, Bedford Park, Ill.) containing 42% by weight of fructose was mixed thoroughly with 10 ml of NaOH solution (33% by weight) in round bottom flask. The mixture was heated to and held at 125° C. for 10 minutes. The reaction mixture obtained was immediately cooled to room temperature using cold water. The resultant composition was tested for the contents of caramel components by the method described in Example 1. The result is shown in Table 1.

TABLE 1

| Sample | Furaneol + Maltol (ppm) | Cyclotene (ppm) | α-Angelica Lactone (ppm) |
|---|---|---|---|
| Example 1 | 25 | 0.0 | 3.0 |
| Example 2 | 327.0 | 108.0 | 17.0 |
| Example 3 | 86.0 | 45.0 | 7.0 |
| DDW 424* | 75.0 | 21.0 | 4.0 |
| DDW 525C-1* | 44.0 | 16.0 | 31.0 |

*Caramel products purchased from D.D. Williamson & Co., Inc., Louisville, KY

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for improving the flavor and aroma characters of a smoking article, comprising:

providing a mixture comprising a reducing sugar and a non-amino base, wherein the reducing sugar is selected from the group consisting of a pure reducing sugar, high fructose corn syrup, a phosphate-substituted reducing sugar, and mixtures thereof;

subjecting said mixture to heat treatment for a time and under conditions sufficient to produce a flavorful caramel composition, wherein said heat treatment is conducted at a temperature of at least about 150° C.;

applying said flavorful composition to a tobacco material; and preparing a smoking article comprising said tobacco material.

2. The method of claim 1, wherein said base is a hydroxide.

3. The method of claim 2, wherein said hydroxide is an alkali metal hydroxide.

4. The method of claim 2, wherein said hydroxide is sodium hydroxide or potassium hydroxide.

5. The method of claim 2, wherein said hydroxide is present in an amount of less than about 30 weight percent on a water-free basis.

6. The method of claim 5, wherein said hydroxide is present in an amount of about 0.5 to about 10 weight percent on a water-free basis.

7. The method of claim 1, wherein said reducing sugar is a pure reducing sugar selected from the group consisting of glucose, fructose, sucrose, mannose, galactose, rhamnose, and mixtures thereof.

8. The method of claim 1, wherein said reducing sugar is a phosphate-substituted reducing sugar selected from the group consisting of glucose-6-phosphate, fructose-6-phosphate, fructose 1,6-diphosphate, and mixtures thereof.

9. The method of claim 1, wherein said reducing sugar is high fructose corn syrup.

10. The method of claim 1, wherein the heat treatment is conducted at a temperature of at least about 175° C.

11. The method of claim 1, wherein the heat treatment is conducted under a pressure of about 20 psig to about 500 psig.

12. The method of claim 1, wherein the heat treatment is conducted for a period of at least about 10 minutes.

13. The method of claim 1, wherein said flavorful composition is applied at an amount of from about 5% to about 8% by weight based on the total dry weight of the tobacco material in the smoking article.

14. The method of claim 1, wherein said mixture further comprises water.

15. A method for improving the flavor and aroma characters of a smoking article, said method comprising:

providing a mixture comprising high fructose corn syrup and a non-amino base;

subjecting said mixture to heat treatment for a time and under conditions sufficient to produce a flavorful composition, wherein said heat treatment is conducted at a temperature of at least about 150° C.;

applying said flavorful composition directly to a tobacco material; and preparing a smoking article comprising said tobacco material.

16. The method of claim 15, wherein said base is a hydroxide.

17. The method of claim 16, wherein said hydroxide is an alkali metal hydroxide.

18. The method of claim 16, wherein said hydroxide is sodium hydroxide or potassium hydroxide.

19. The method of claim 16, wherein said hydroxide is present in an amount of less than about 30 weight percent on a water-free basis.

20. The method of claim 19, wherein said hydroxide is present in an amount of about 0.5 to about 10 weight percent on a water-free basis.

21. The method of claim 15, wherein the heat treatment is conducted at a temperature of at least about 175° C.

22. The method of claim 15, wherein the heat treatment is conducted under a pressure of about 20 psig to about 500 psig.

23. The method of claim 15, wherein the heat treatment is conducted for a period of at least about 10 minutes.

24. The method of claim 15, wherein said flavorful composition is applied at an amount of from about 5% to about 8% by weight based on the total dry weight of the tobacco material in the smoking article.

25. The method of claim 15, wherein said mixture further comprises water.

26. A method for improving the flavor and aroma characters of a smoking article, comprising;

providing an aqueous mixture comprising water, high fructose corn syrup, and a hydroxide;

subjecting said mixture to heat treatment for a time and under conditions sufficient to produce a flavorful caramel composition, wherein said heat treatment is conducted at a temperature of at least about 150° C.;

applying said flavorful composition to a tobacco material; and preparing a smoking article comprising said tobacco material.

* * * * *